US011610749B2

(12) United States Patent
Yang

(10) Patent No.: US 11,610,749 B2
(45) Date of Patent: Mar. 21, 2023

(54) PROGRAMMABLE TIMER OUTLET

(71) Applicant: Daniel H. Yang, Ormond Beach, FL (US)

(72) Inventor: Daniel H. Yang, Ormond Beach, FL (US)

( * ) Notice: Subject to any disclaimer, the term of this patent is extended or adjusted under 35 U.S.C. 154(b) by 274 days.

(21) Appl. No.: 17/128,983

(22) Filed: Dec. 21, 2020

(65) Prior Publication Data

US 2022/0199344 A1 Jun. 23, 2022

(51) Int. Cl.

| | |
|---|---|
| ***H01H 43/04*** | (2006.01) |
| ***H01R 13/70*** | (2006.01) |
| ***H01H 19/14*** | (2006.01) |
| *H01R 13/717* | (2006.01) |

(52) U.S. Cl.

CPC ..... *H01H 43/04* (2013.01); *H01H 19/14* (2013.01); *H01R 13/70* (2013.01); *H01H 2019/143* (2013.01); *H01R 13/7175* (2013.01)

(58) Field of Classification Search

CPC ..... H01R 13/66–7197

See application file for complete search history.

(56) References Cited

U.S. PATENT DOCUMENTS 6,798,631 B1 * 9/2004 Farsetta ..... G04G 15/003 361/115
9,762,056 B1 * 9/2017 Miller ..... H01R 25/003
2013/0200704 A1 * 8/2013 Pyle ..... H01R 25/003 307/31
2015/0061546 A1 * 3/2015 Stack ..... G04G 15/006 307/115

FOREIGN PATENT DOCUMENTS

CN 104300320 A * 1/2015 ..... H01R 13/665
KR 2013054936 A * 5/2013

OTHER PUBLICATIONS

NEARPOW T319, May 26, 2016, Amazon.com listing (Year: 2016).*
NEARPOW T319 User Manual, May 26, 2016 (Year: 2016).*
TECHBEE T319, Sep. 17, 2020, Amazon.com listing (Year: 2020).*
TECHBEE T319 User Manual, Sep. 17, 2020, (Year: 2020).*
Tork EJWT, Sep. 30, 2011, Amazon.com listing (Year: 2011).*
PEMENOL timer, Oct. 24, 2019, Amazon.com listing (Year: 2019).*
PEMENOL timer User Manual, Oct. 24, 2019 (Year: 2019).*

* cited by examiner

*Primary Examiner* — Toan T Vu
*Assistant Examiner* — David A Shiao
(74) *Attorney, Agent, or Firm* — J. Wiley Horton

(57) ABSTRACT

A switched power receptacle that can be programmed to provide power for a user-selected duration in a user-selected cycle. The invention can be plugged into a conventional receptacle, extension cord, or other source of power. One or more user inputs and displays are provided so that the user can program the cycle for switching on the power (once every 2 days, once every 7 days, etc.). One or more user inputs are provided so that the user can select the duration of activation for each cycle (1 hour, 3 hours, etc.). Status indicators are preferably provided so that the user can easily monitor the operation of the device.

20 Claims, 12 Drawing Sheets

PROGRAMMABLE TIMER OUTLET

STATEMENT REGARDING FEDERALLY SPONSORED RESEARCH OR DEVELOPMENT

Not Applicable

CROSS-REFERENCES TO RELATED APPLICATIONS

Not Applicable

MICROFICHE APPENDIX

Not Applicable

BACKGROUND OF THE INVENTION

1. Field of the Invention

This invention relates to the field of electrical power distribution. More specifically, the invention comprises a switched electrical outlet that can be programmed to switch on for a user-selectable duration on a user-selectable repetition cycle.

2. Description of the Related Art

Prior art timer devices are available for switching on and off a power receptacle on a fixed schedule. These devices ordinarily run on a 24-hour cycle, with the assumption that the switching is to be performed the same way each day. As an example, many such devices are programmed to turn on one or more receptacles providing power to a house's interior lights around sundown and switch them off again at bedtime.

Most such devices plug into a wall receptacle and provide a switched output receptacle. Power for the operation of the device is provided by the wall receptacle itself. Thus, once programmed, these prior art devices can be expected to continue operating on a daily cycle for an extended period.

While the prior art devices work well for switching light sources and similar items, they do not serve the need for the control of devices operating on a cycle longer than a day. Some devices need to be energized once every 3 days, once a week, or even once a month. There are many such devices. One good example is a battery used in a standby generator. Depending on the battery used, it might be desirable to provide a charging cycle once every 14 days. The present invention provides this functionality, as well as many other features that may be programmed by a user.

BRIEF SUMMARY OF THE PRESENT INVENTION

The present invention comprises a switched power receptacle that can be programmed to provide power for a user-selected duration in a user-selected cycle. The invention can be plugged into a conventional receptacle, extension cord, or other source of power. One or more user inputs and displays are provided so that the user can program the cycle for switching on the power (once every 2 days, once every 7 days, etc.). One or more user inputs are provided so that the user can select the duration of activation for each cycle (1 hour, 3 hours, etc.). Status indicators are preferably provided so that the user can easily monitor the operation of the device.

REFERENCE NUMERALS IN THE DRAWINGS

Figure 1:
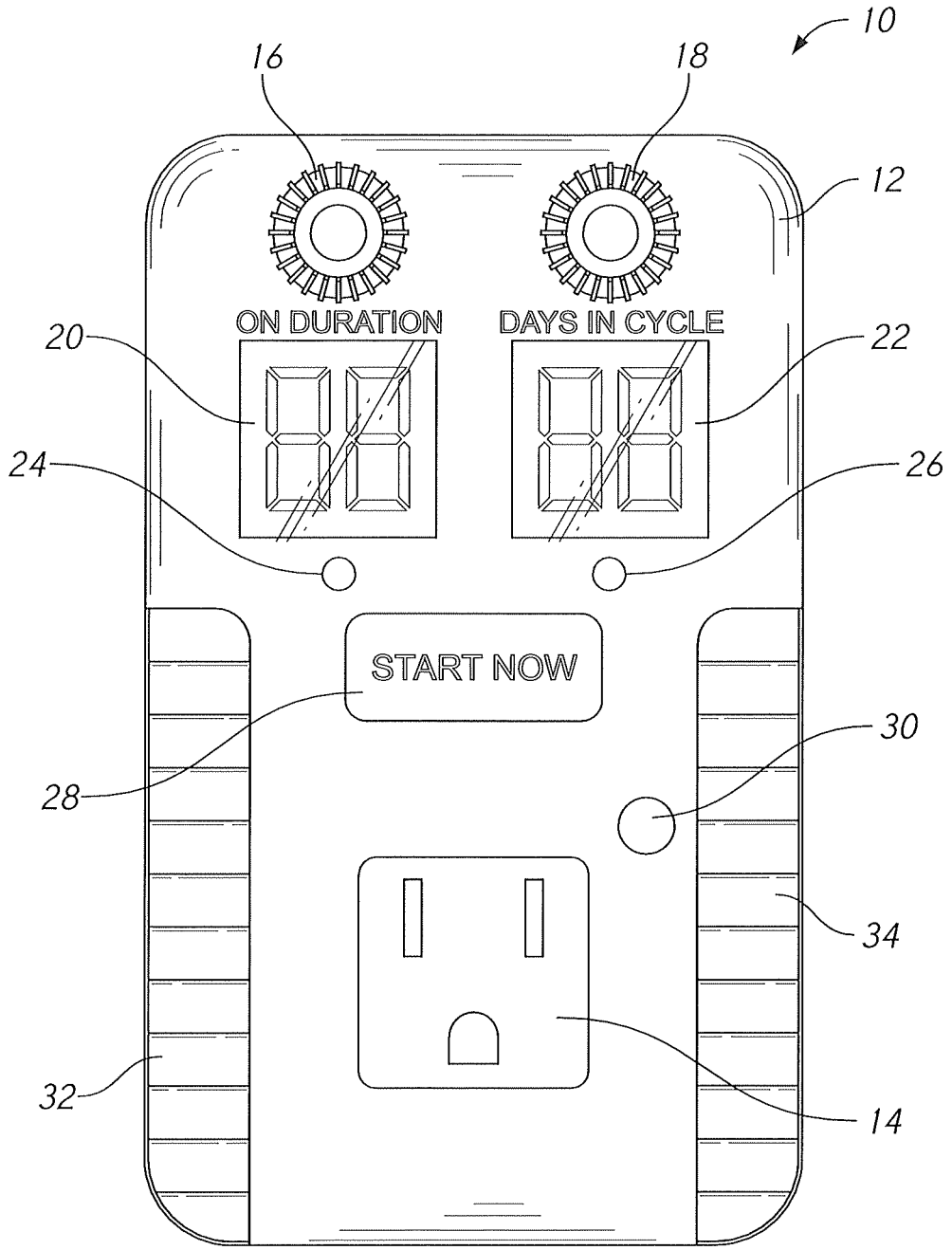
FIG. 1 is a front elevation view, showing the view of an embodiment of the invention customarily seen by the user when the invention is in use.

10 programmable timer outlet
12 housing
14 switched receptacle
16 first rotary dial
18 second rotary dial
20 first display
22 second display
24 red status LED
26 green status LED
28 input button
30 amber status LED
32 grip panel
34 grip panel
36 male plug
38 back panel
40 duplex outlet
42 upper receptacle
44 lower receptacle
46 cover plate
48 plug
50 cord
52 baseboard
54 power switch
56 power supply
58 memory
60 processor
62 display driver
64 display driver
66 LED driver
68 LED driver
70 LED driver
72 battery
74 battery charger
76 first switched receptacle
78 second switched receptacle
80 control line

DETAILED DESCRIPTION OF THE INVENTION

The following descriptions pertain to embodiments of the present invention. The invention may be embodied in a wide variety of ways. The scope of the invention should be fixed by the claims rather than any particular embodiment. However the following descriptions will assist the understanding of one skilled in the art.

A preferred embodiment is configured to plug directly into a wall electrical outlet. Such an embodiment can be plugged into other power sources—such as an extension cord or a generator. However, the physical form of the preferred embodiment is configured for use with a wall outlet.

FIG. 1 provides an elevation view of the outward facing side of the device. Programmable timer outlet 10 is configured to be plugged into an electrical powers source such as a wall outlet. The device selectively energizes switched receptacle 14. The switched receptacle is energized on a schedule that is programmed by the user. Two parameters are used—the cycle interval and the duration period. The cycle interval determines the length of time before a cycle repeats. In the version shown, the cycle interval can be varied between 1 day and 99 days.

The duration period refers to the amount of time the switched receptacle remains on during one cycle interval. As a first example, the user selects a cycle interval of 14 days and a duration period of 30 hours. In the example shown the cycle is started by pressing input button 28. When the input button is pressed, switched receptacle 14 is energized. The switched receptacle then remains energized for 30 hours, after which it is switched off. The switched receptacle then remains off until the entire cycle interval of 14 days has elapsed. Upon the completion of the 14 days switched receptacle 14 is again switched on and the entire sequence repeats. The sequence repeats indefinitely until stopped by the user.

As a second example the user selects a cycle interval of 30 days and a duration period of 2 hours. The user then presses input button 28. Switched receptacle 14 is energized and remains energized for 2 hours. It is then switched off. The switched receptacle remains off until the entire 30-day sequence is completed. The sequence is then repeated.

Figure 2:
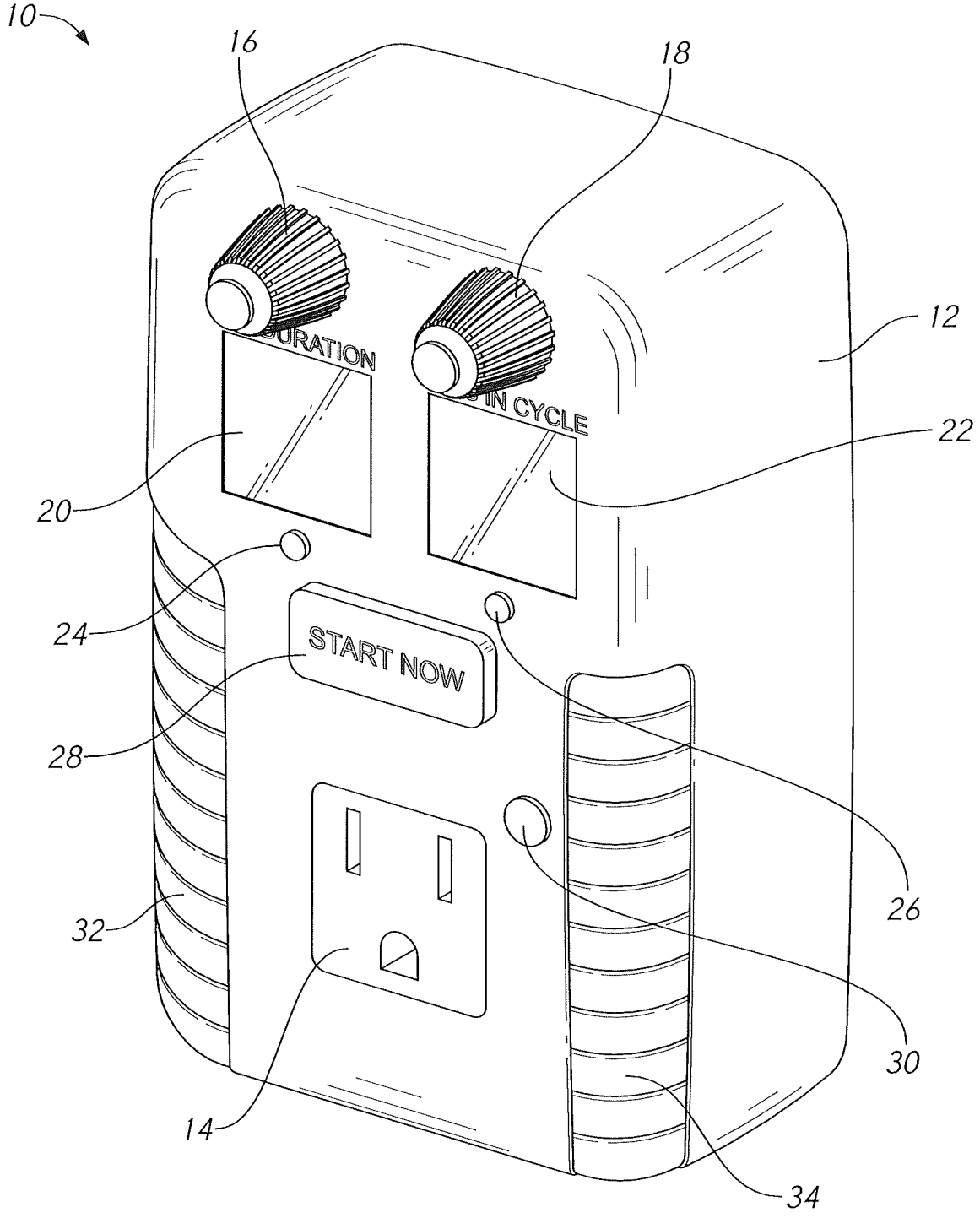
FIG. 2 is a perspective view, showing the front and side of an embodiment of the invention.
Figure 3:
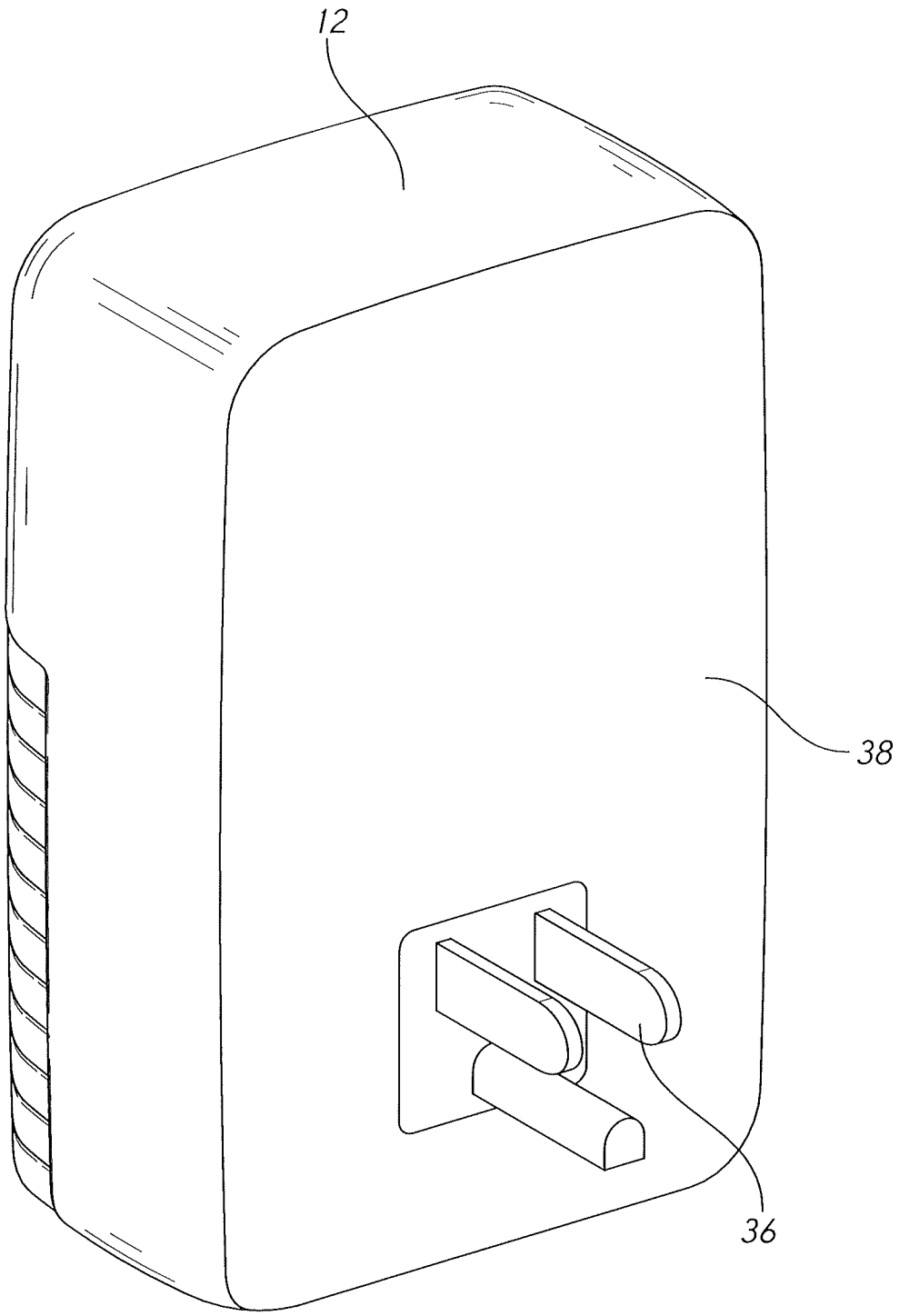
FIG. 3 is a perspective view, showing the back of the embodiment of FIG. 1.
Figure 5:
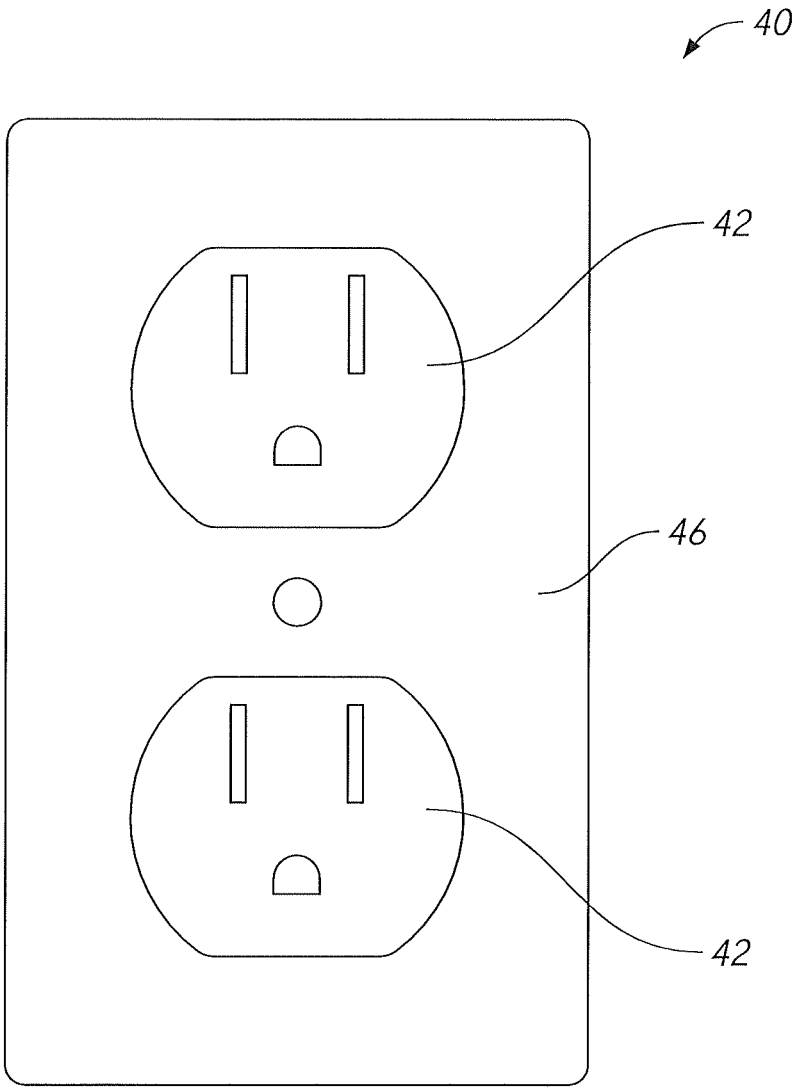
FIG. 5 (PRIOR ART)
FIG. 5 is an elevation view, showing a prior art duplex receptacle.

The physical packaging of the device is somewhat arbitrary, but a brief explanation will benefit the reader's understanding. FIG. 2 provides a perspective view of the same embodiment depicted in FIG. 1. Housing 12 contains switched receptacle 14 and user input and display devices. FIG. 3 shows the same embodiment from the rear. Male plug 36 is provided on back panel 38. This male plug is used to connect the inventive device to a wall outlet or an extension cord. Those skilled in the art will know that most wall outlets are duplex outlets—meaning that they include a pair of electrical receptacles fed by a common circuit. FIG. 5 depicts a prior art duplex outlet 40, including upper receptacle 42 and lower receptacle 44 (Cover plate 46 covers the exposed portion of the outlet box and provides a finished appearance to the installation).

Figure 6:
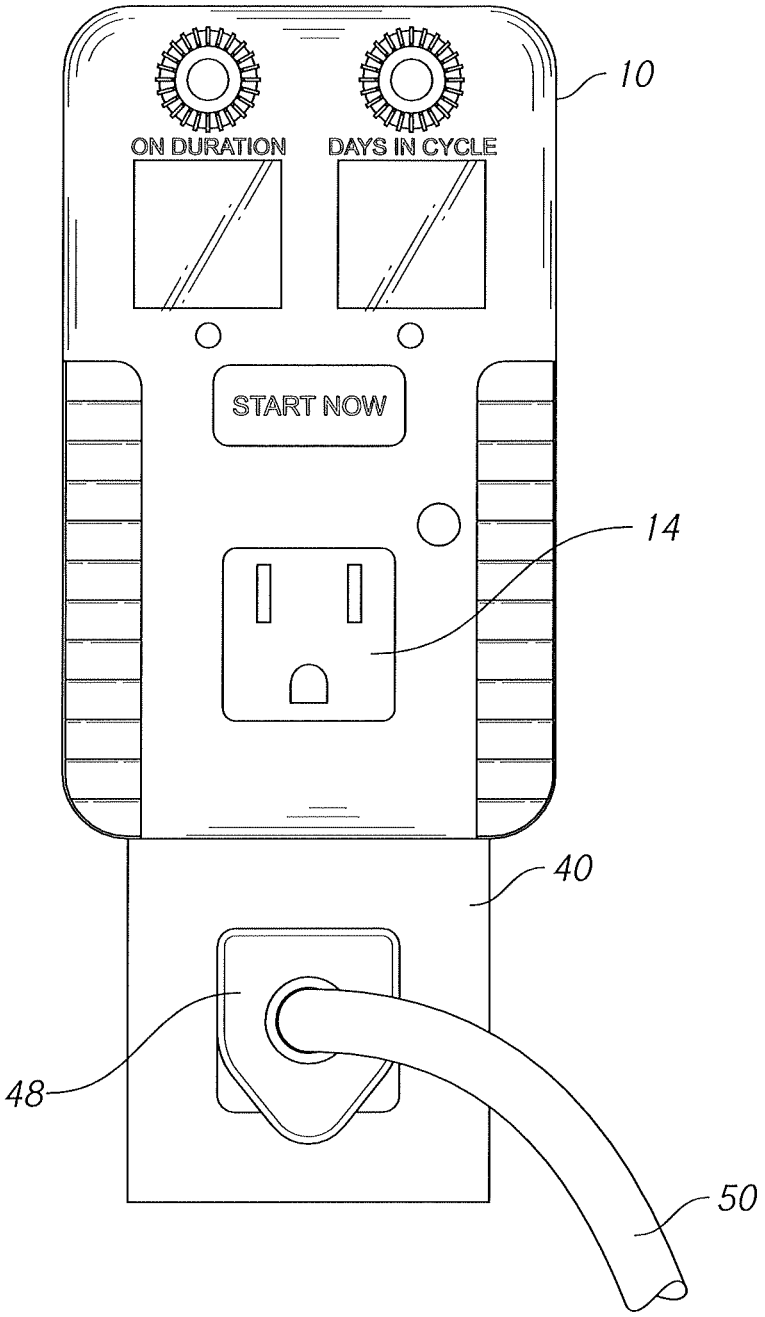
FIG. 6 is an elevation view, showing an embodiment of the present invention plugged into a duplex receptacle.

It is useful for the inventive device to be capable of being plugged into one of the two duplex outlets without occluding the second outlet. In the version of FIG. 3, male plug 36 is provided near the bottom of back panel 38. FIG. 6 shows the embodiment of FIG. 3 when it is plugged into duplex outlet 40. The lower receptacle remains accessible so that clearance is provided for plug 48 and cord 50—which are used to feed a separate electrical device that does not need to be switched by the present invention.

Figure 4:
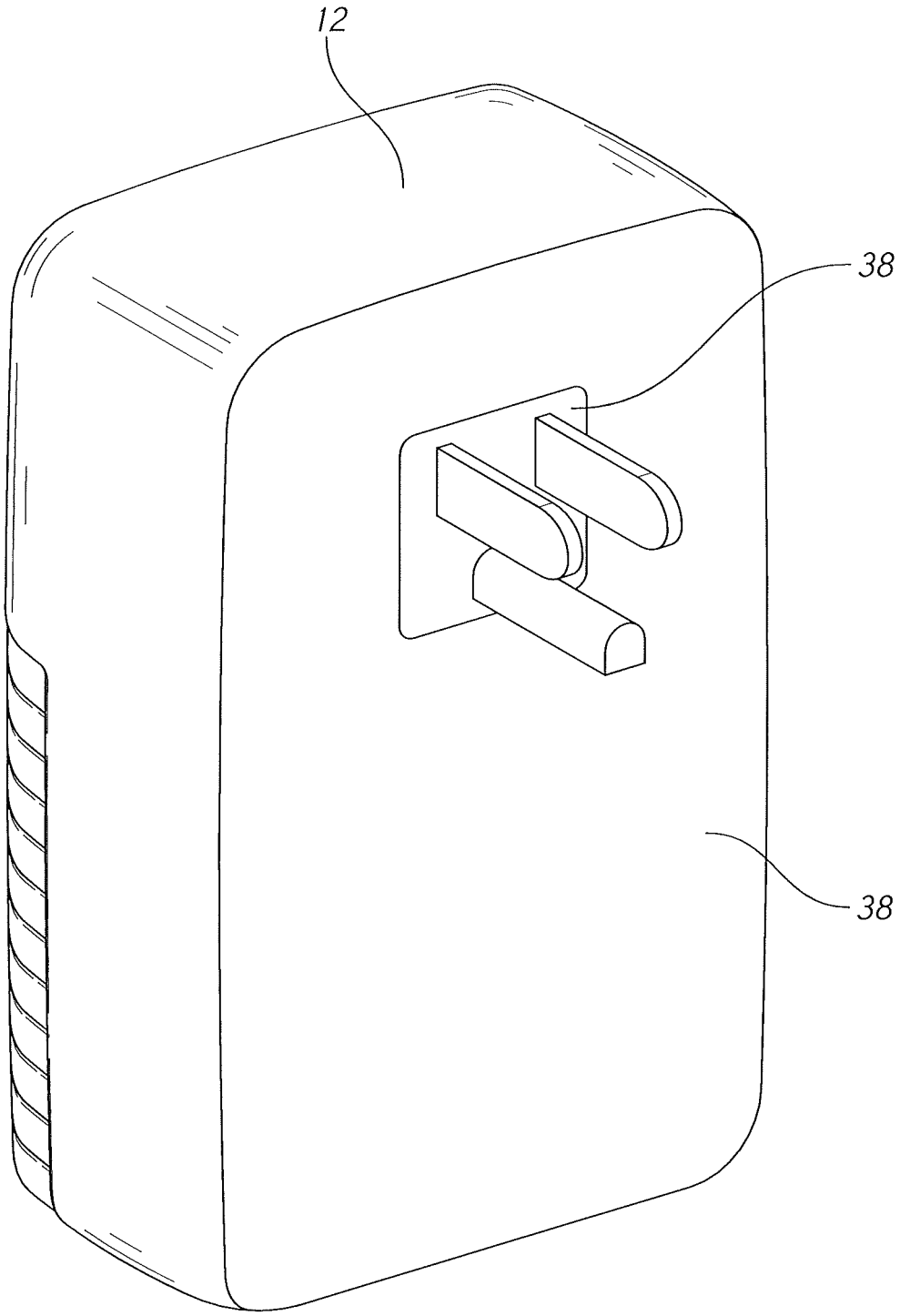
FIG. 4 is a perspective view, showing an alternate embodiment for the location of the male plug.
Figure 7:
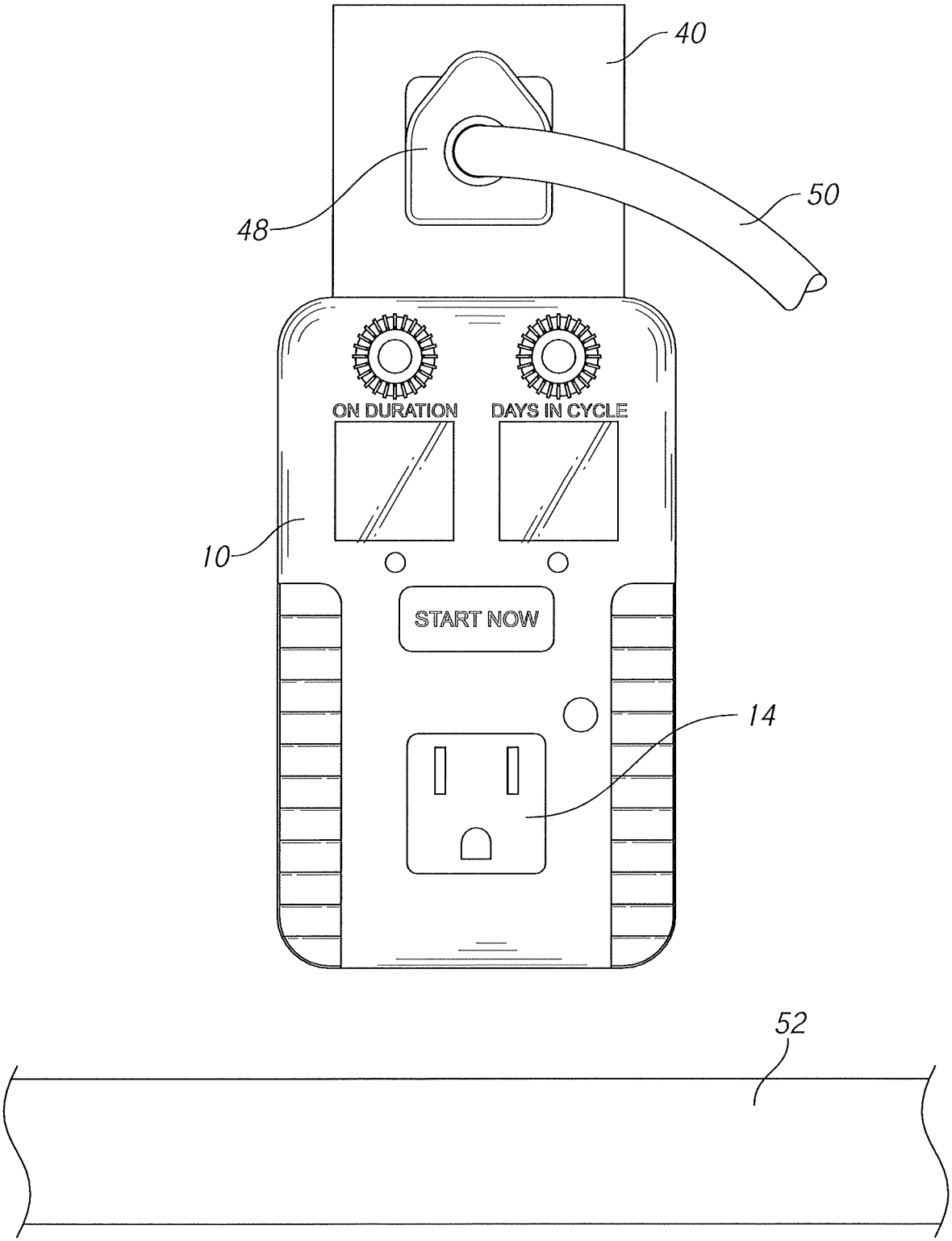
FIG. 7 is an elevation view, showing an embodiment of the present invention plugged into a duplex receptacle.

FIG. 4 shows an alternate embodiment in which male plug 36 is placed near the upper portion of back panel 38. FIG. 7 shows the embodiment of FIG. 4 plugged into the lower receptacle of duplex outlet 40. In this embodiment the upper receptacle of the duplex outlet remains open for access by plug 48 and cord 50. The version shown in FIG. 7 is often preferable because the weight of programmable timer outlet 10 "hangs" below the receptacle it is plugged into. However, this version requires enough vertical clearance between the position of duplex outlet 40 and baseboard 52 or the floor. Such clearance is not always available and in those instances, it will be preferable to employ the version of FIG. 3.

Returning now to FIG. 1, some details of the preferred embodiments will be described. The inventive timer outlet is preferably provided with suitable user input devices and display devices. In the example shown in FIG. 1, first rotary dial 16 and second rotary dial 18 are provided. First display 20 is provided next to first rotary dial 16 and second display 22 is provided next to second rotary dial 18.

It is preferable to provide a simple programming methodology. A programmable processor is used to control the operations of the device. In the embodiment shown, the programming mode is entered by pressing input button 28 twice in quick succession (such as twice within a 2 second interval). Once the programming mode is entered, first display 20 and second display 22 will blink continuously. The user sets the duration period using first rotary dial 16 and the currently set duration period is displayed on first display 20.

The user increases the value for the duration period by turning first rotary dial 16 in the clockwise direction and decreases the value by turning first rotary dial 16 in the anticlockwise direction. The two rotary dials 16, 18 are preferably digital devices that transmit a series of pulses depending on the direction in which they are turned. Unlike an analog rheostat, they do not have a limit of travel. In other words, a user can continue turning one of these dials in the same direction indefinitely. In one version these rotary dials transmit a series of output pulses on a first output line for the clockwise direction and a second output line for the anticlockwise direction. Such devices are now commonly used as rotary inputs for aftermarket car stereos and other similar devices. They are well known to one skilled in the art.

The user sets the cycle interval using second rotary dial 18. The user increases the cycle interval by turning this dial in the clockwise direction and decreases the cycle interval by turning this knob in the anticlockwise direction.

The two displays 20, 22 can assume any suitable form. In the example shown in FIG. 1, the two displays are LCD numeric displays having two characters each. Each character includes 7 separately switched LCD segments in the familiar "8" pattern (commonly known as a seven-segment display) Each character can therefore display the numerals 0 through 9.

A simple example will clarify the use of these rotary input dials: First the user enters the program mode by pressing input button 28 twice in quick succession. Once this is done, the two LCD characters in each display begin to flash. In this example both displays 20, 22 flash "00." The user can program the two parameters in any sequence. In this instance the user first programs the duration period by turning first rotary dial 16 in the clockwise direction. As soon as first rotary dial 16 is turned first display 20 stops flashing and displays the current value for the duration period. Thus, first display 20 displays an increasing number as the user continues to turn first display dial 16 in the clockwise direction. In this example the user stops once 35 has been entered. Thus, the duration period has been set to 35 hours.

Figure 10:
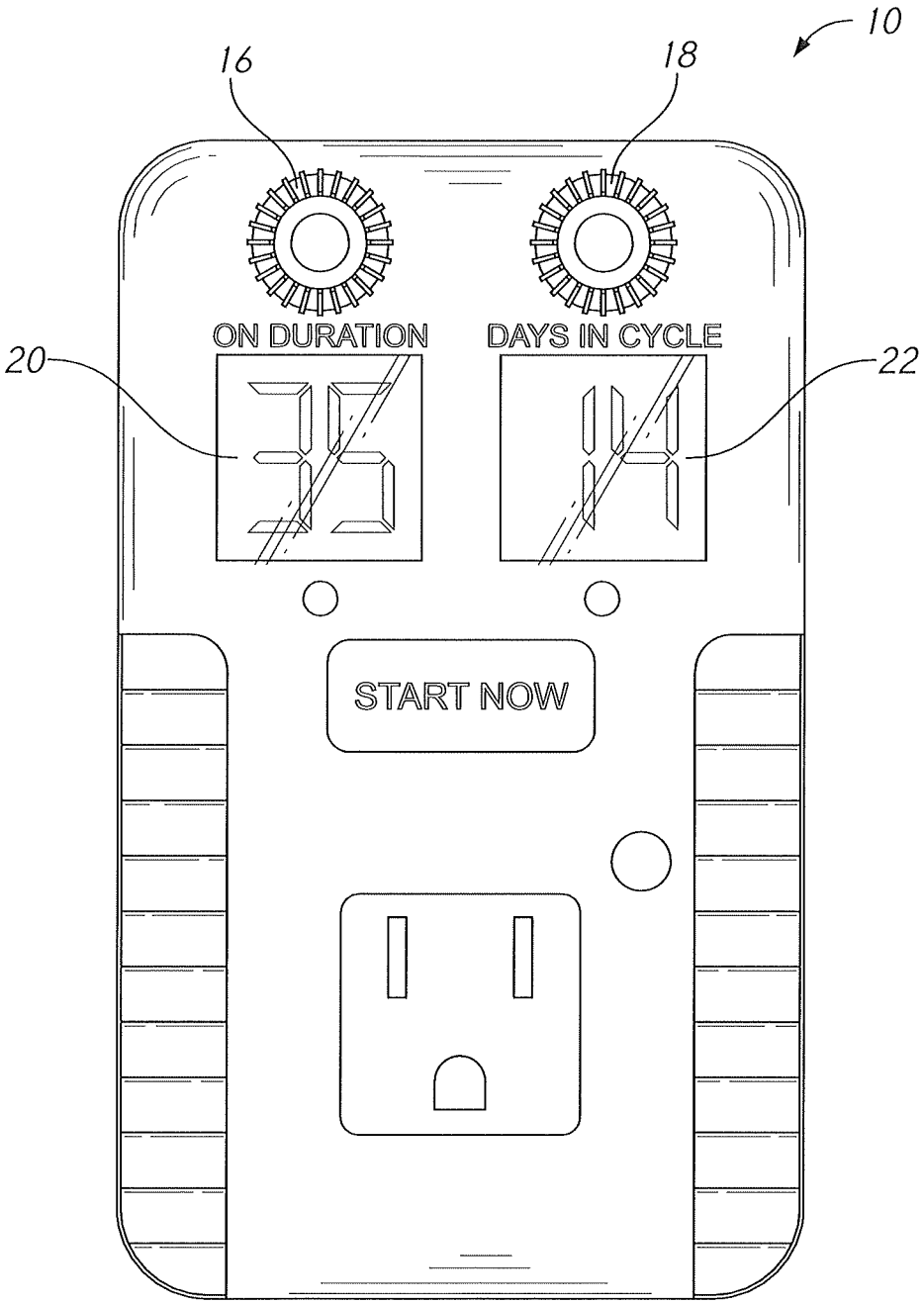
FIG. 10 is an elevation view, showing an exemplary display status.

Next the user programs the cycle interval by turning second rotary dial 18 in the clockwise direction. Once second rotary dial 18 is turned second display 22 stops flashing and displays the current value for the duration period. This value increases as the user continues to rotate second rotary dial 18 in the clockwise direction. In this example the user stops when second display 22 reads "20." At this point the user realizes that the cycle interval must be reduced as 14 days was the desired value. The user again grasps second rotary dial 18 and turns the dial in the anticlockwise direction. Second display 22 then begins to show a decreasing number. The user stops when 14 is displayed in second display 22. This display status is shown in FIG. 10.

Additional changes can be made as desired. Once the user is satisfied with the values displayed in first display 20 and second display 22 programming is complete. To initiate the sequence the user then presses input button 28 again. This action energizes switched receptacle 14 and starts the programmed sequence.

It is helpful to provide additional status indications so that a user can easily monitor the operation of the inventive device. Status lights are a useful example. Looking again at the embodiment shown in FIG. 1, red status light LED 24 and green status light 26 are provided. Red status LED 24 is illuminated whenever the programmed status is not active. As soon as the repeating cycle commences red status LED is turned off and green status LED 26 is illuminated. Green status LED 26 remains illuminated as long as the programmed sequence is running. The programmed sequence can of course run for days, weeks, months, or years.

If the user wishes to re-initiate the programmed sequence at any time he or she presses input button 38 once. This will cause red status LED 24 to flash on for an instant and then turn off, at which point green status LED 26 will illuminate. The user can also reprogram the device at any time by pressing input button 28 twice in rapid succession. During the program mode red status LED 24 will be illuminated and green status LED 26 will be switched off. The reader should recognize that this display configuration is a reasonable choice but that it is merely exemplary. The device can be configured in different ways.

Amber status LED 30 is provided to indicate the status of switched receptacle 14. If power is presently being provided to the switched receptacle then amber status LED 30 is illuminated. If the switched receptacle is turned off then amber status LED 30 is turned off as well.

The inventive device is preferably provided with other features that facilitate its convenient use. FIG. 2 provides a good view of housing 12. The housing is preferably a molded plastic enclosure that contains and protects the components of the invention. In this example the entire housing must be gripped in order to plug in the device or unplug the device. Grip panels 32, 34 are provided along the sides of the housing. These grip panels are preferably high-friction surfaces that allow a user to more easily grasp the housing. They may be separate pieces that are glued or otherwise fastened to the housing. They may also be overmolded as part of the manufacturing process.

Figure 8:
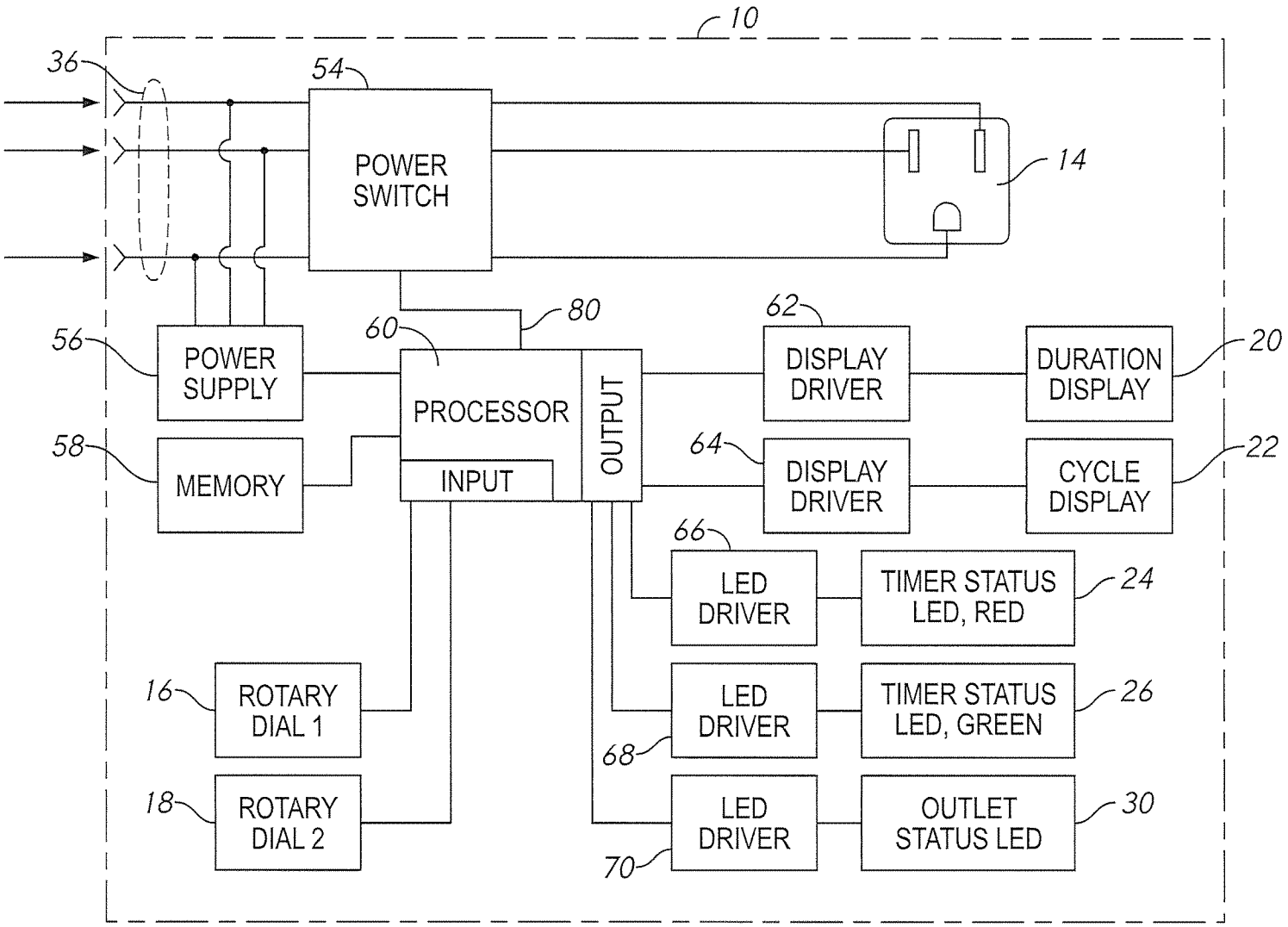
FIG. 8 is a schematic view, showing an exemplary block diagram of the electronic components of an embodiment of the invention.

FIG. 8 provides a schematic showing some internal features of the inventive device. The reader should bear in mind that the significant features of the invention can be implemented in a wide variety of ways. The example shown in FIG. 8 is one example among many different possibilities.

In the version shown in FIG. 8, processor 60 runs a software program that directs the actions carried out by the inventive device. The program is stored within memory 58. Operational parameters used in running the program can be stored in memory 58 or on board processor 60 itself. A backup power supply is preferably provided so that the operational state of the parameters will not be lost in the event of a power failure. A separate battery may be used for this function. A capacitor bank may also be used. Either of these approaches can be incorporated into power supply 56 or added as a separate device.

Male plug 36 provides power to power supply 56 and power switch 54. The control of power switch 54 is the ultimate objective of the device. It makes or breaks the connection between the input power and switched receptacle 14.

Power supply 56 rectifies and filters the AC input power and provides suitable DC power to the other components shown in the block diagram (The connections between the power supply and the other components is not shown for purposes of visual clarity). Processor 60 has multiple input ports and multiple output ports. First rotary dial 16 and second rotary dial 18 provide information to the input ports of the processor. The output ports of the processor feed information to the various displays. Display driver 62 is provided to take information from the processor and convert it into an appropriate display for duration display 20. Display driver 64 is provided to take information from the processor and drive the information displayed by cycle display 22.

LED driver 66 regulates the state of red status LED 24 depending on information provided by the processor. LED driver 68 regulates the state of green status LED 26 depending on processor-supplied information. Likewise, LED driver 70 regulates the status of outlet status LED 30.

Processor 60 controls the operation of power switch 54 by altering the output of control line 80. Power switch 54 can assume many forms. In one form, a 3-pole relay is used (with an individual pole switching the line lead, the neutral lead, and the ground lead). A low-current control line can be used to control such a device. Control line can be controlled directly from the processor. Alternatively, control line 80 can control a higher-current relay that then controls power switch 54. Since there is no need for high-speed switching, many control arrangements will work between processor 60 and power switch 54. In some embodiments the power switch itself may contain internal switching circuitry with only the need for an external low-current control line.

Figure 9:
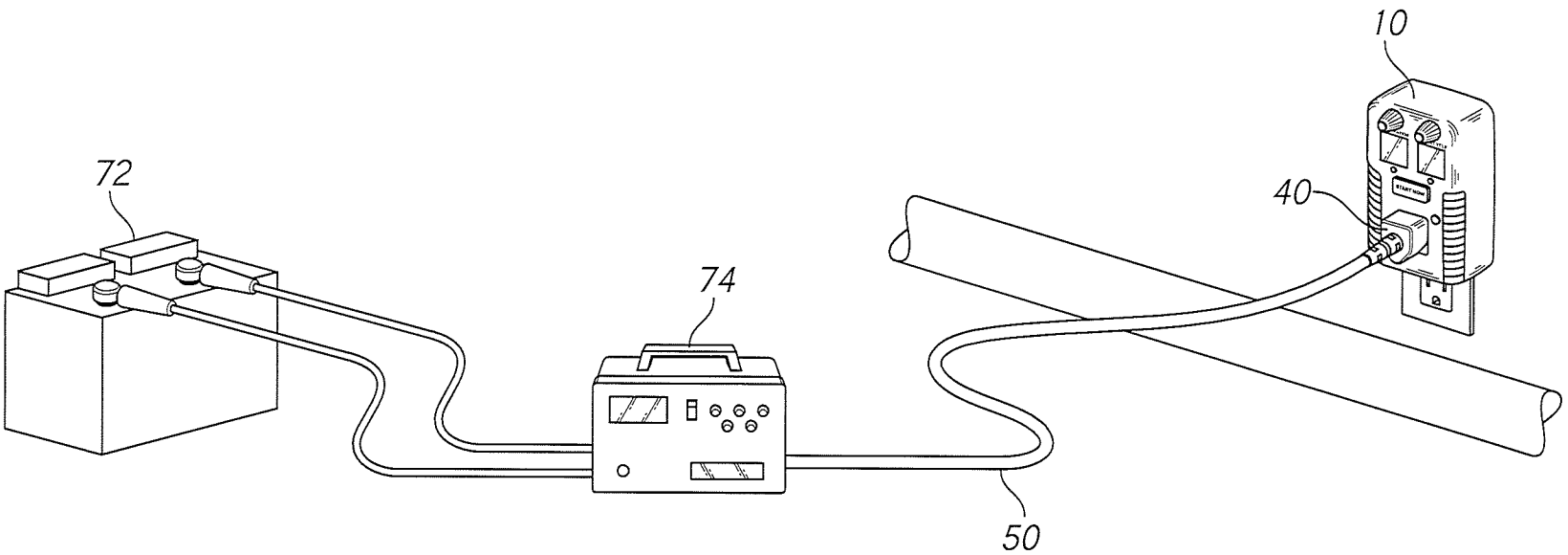
FIG. 9 is a perspective view, showing an exemplary application for the invention.

The inventive programmable timer outlet has many possible uses. FIG. 9 illustrates one common use. A battery that is used infrequently must often be charged in between uses. Battery 72 is shown as a free-standing item but in actuality it might be part of a generator or an auxiliary sump pump. Battery charger 74 is connected to the battery. Cord 50 from battery charger 74 is plugged into the switched receptacle on programmable timer outlet 10. The programmable timer outlet is then programmed to provide suitable charging according to a programmed schedule.

Figure 11:
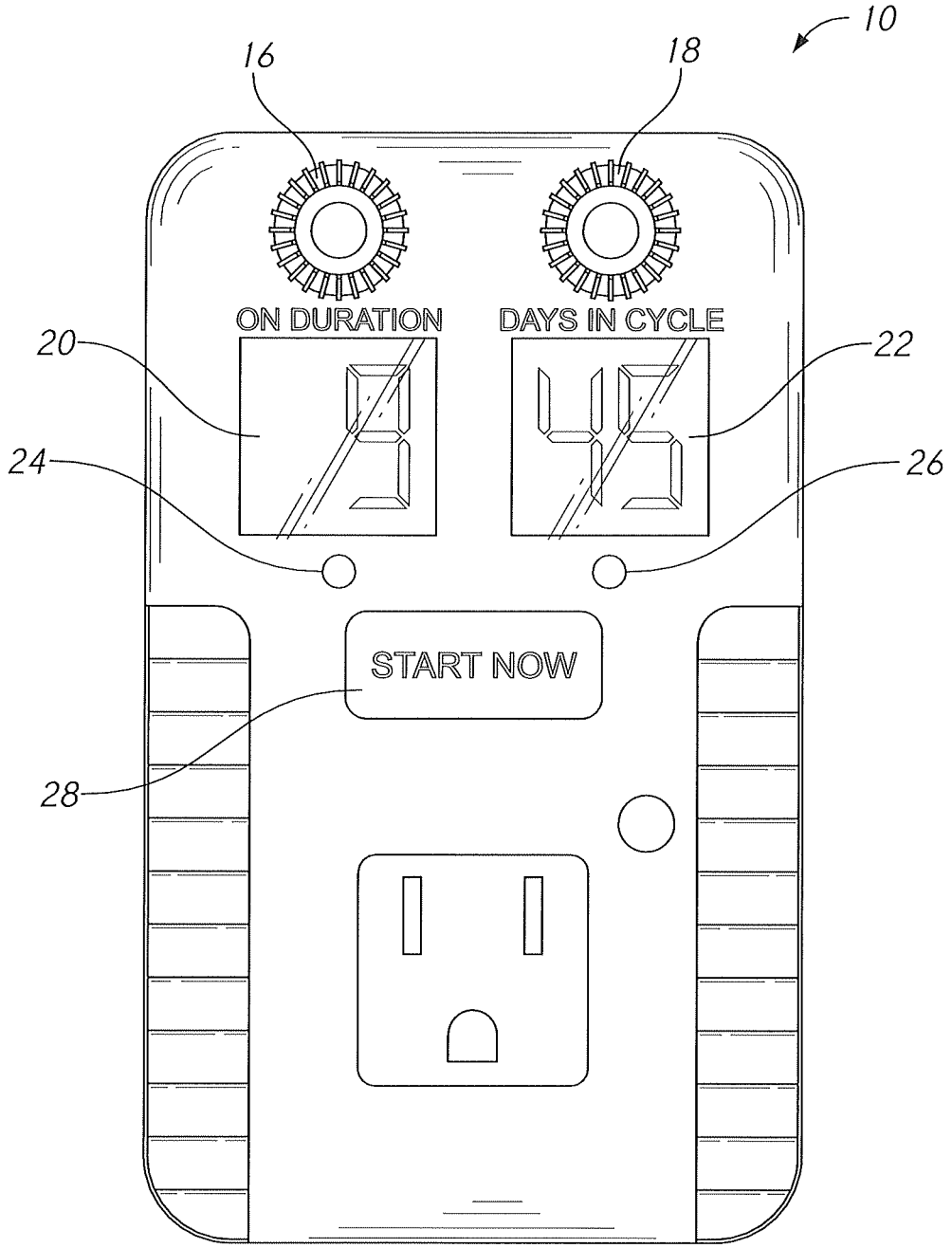
FIG. 11 is an elevation view, showing an exemplary display status.
Figure 12:
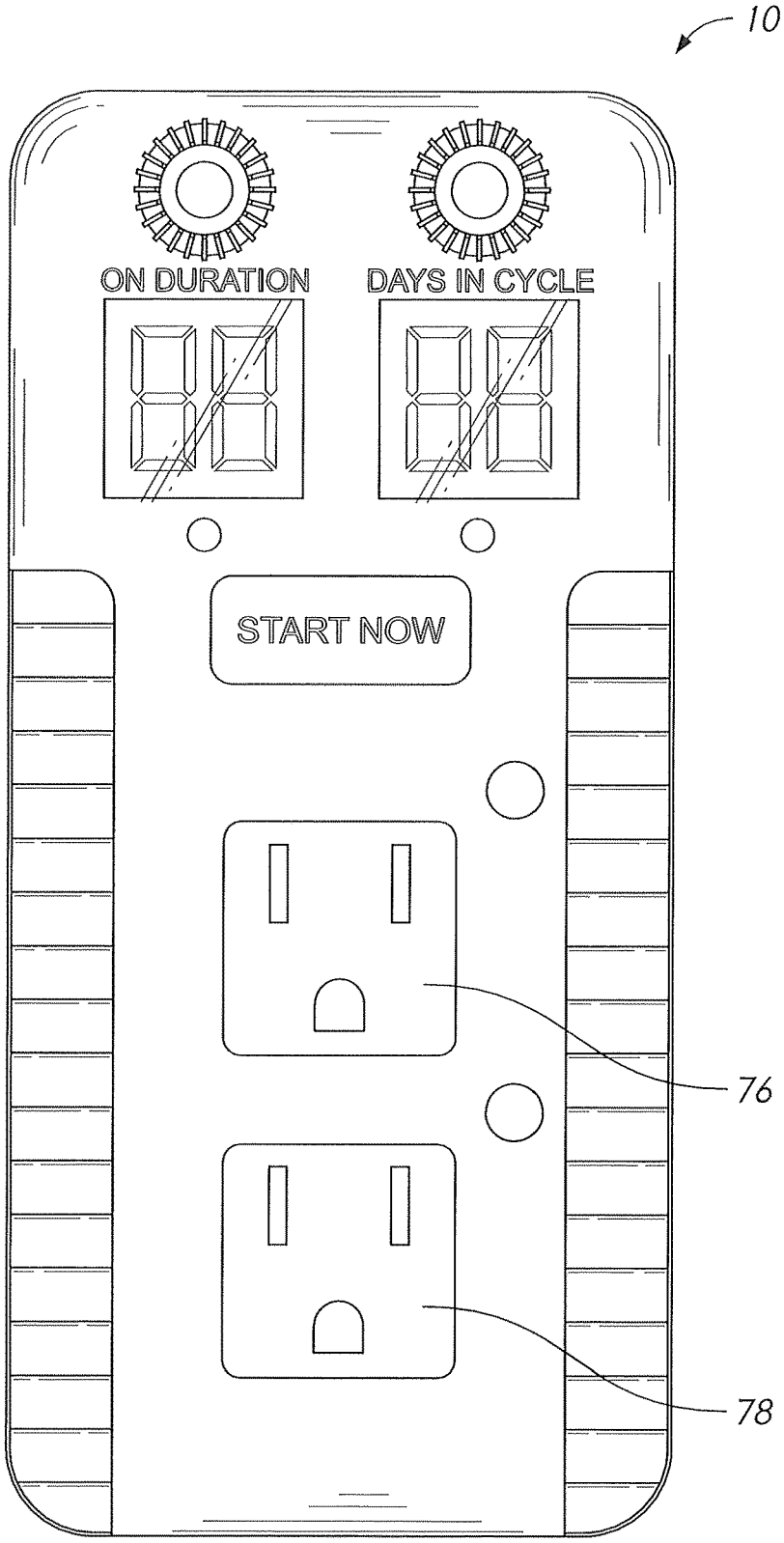
FIG. 12 is an elevation view, showing an alternate embodiment including two switched receptacles.

Many other inventive embodiments are possible. FIGS. 11 and 12 show two possibilities. In the embodiment of FIG. 11, a duration period that is set in hours and minutes is provided. By pressing an appropriate sequence on input button 28, this enhanced functionality is accessed. First display 20 then shows the number of hours and second display 22 then shows the number of minutes. Turning first rotary dial 16 sets the number of hours and turning second rotary dial 18 sets the number of minutes. It is also possible to provide hour and minute programming for the cycle interval.

FIG. 12 shows yet another embodiment of the inventive switched outlet. This version includes two switched receptacles—first switched receptacle 76 and second switched receptacle 78. The operation of these two switched receptacles may be independently programmed or they may be ganged together.

Although the preceding description contains significant detail, it should not be construed as limiting the scope of the invention but rather as providing illustrations of the preferred embodiments of the invention. Numerous other permutations and modifications will be apparent to those skilled in the art. Thus, the scope of the invention should be fixed by the following claims rather than the examples given.

Having described my invention, I claim:

1. A programmable switched receptacle configured to be programmed by a user, comprising:

(a) a multi-prong input plug configured to plug into a separate power source;
(b) an output receptacle;
(c) a power switch configured to selectively connect said input plug to said output receptacle;
(d) a processor configured to control said power switch;
(e) said processor being programmable by said user to establish a duration period;
(f) said processor being programmable by said user to establish a cycle interval;
(g) a first user input configured to allow said user to select and program a first time value for said duration period into said processor;
(h) a second user input configured to allow said user to select and program a second time value for said cycle interval into said processor;
(i) a first display configured to display said duration period;
(j) a second display configured to display said cycle interval; and
(k) wherein said processor periodically activates said power switch once per said cycle interval and keeps said power switch activated for said duration period.

2. The programmable switched receptacle as recited in claim 1, wherein said cycle interval is programmable between a minimum of 1 day and a maximum of multiple days.

3. The programmable switched receptacle as recited in claim 2, wherein said cycle interval is programmable between a minimum of 1 day and a maximum of 99 days.

4. The programmable switched receptacle as recited in claim 1, wherein said duration period is programmable between a minimum of 1 hour and a maximum of multiple hours.

5. The programmable switched receptacle as recited in claim 4, wherein said duration period is programmable between a minimum of 1 hour and a maximum of 99 hours.

6. The programmable switched receptacle as recited in claim 1, wherein said first user input is a first rotary dial.

7. The programmable switched receptacle as recited in claim 6, wherein said second user input is a second rotary dial.

8. The programmable switched receptacle as recited in claim 1, further comprising an outlet status indicator located proximate said output receptacle.

9. The programmable switched receptacle as recited in claim 1, further comprising an input button used to start said cycle interval.

10. The programmable switched receptacle as recited in claim 9, wherein said input button is also configured to be used in said programming of said processor.

11. A programmable switched receptacle configured to be programmed by a user, comprising:

(a) an input configured to plug into a separate power source;
(b) an output receptacle;
(c) a processor configured to control a selective connection of said output receptacle to said power source;
(d) said processor being user programmable to set both a duration period and a cycle interval;
(e) a first user input configured to allow said user to select and program a first time value for said duration period into said processor;
(f) a second user input configured to allow said user to select and program a second time value for said cycle interval into said processor; and
(g) wherein said processor periodically closes said selective connection once per said cycle interval and keeps said selective connection closed for said duration period.

12. The programmable switched receptacle as recited in claim 11, wherein said cycle interval is programmable between a minimum of 1 day and a maximum of multiple days.

13. The programmable switched receptacle as recited in claim 12, wherein said cycle interval is programmable between a minimum of 1 day and a maximum of 99 days.

14. The programmable switched receptacle as recited in claim 11, wherein said duration period is programmable between a minimum of 1 hour and a maximum of multiple hours.

15. The programmable switched receptacle as recited in claim 14, wherein said duration period is programmable between a minimum of 1 hour and a maximum of 99 hours.

16. The programmable switched receptacle as recited in claim 11, wherein said first user input is a first rotary dial.

17. The programmable switched receptacle as recited in claim 16, wherein said second user input is a second rotary dial.

18. The programmable switched receptacle as recited in claim 11, further comprising an outlet status indicator located proximate said output receptacle.

19. The programmable switched receptacle as recited in claim 11, further comprising an input button used to start said cycle interval.

20. The programmable switched receptacle as recited in claim 19, wherein said input button is also configured to be used in said programming of said processor.

* * * * *